US010281126B2

(12) United States Patent
Sonneman

(10) Patent No.: US 10,281,126 B2
(45) Date of Patent: May 7, 2019

(54) POWER BAR HANGER FOR MODULAR LIGHTING SYSTEM

(71) Applicant: Contemporary Visions, LLC, Larchmont, NY (US)

(72) Inventor: Robert A. Sonneman, Mamaroneck, NY (US)

(73) Assignee: CONTEMPORARY VISIONS, LLC, Larchmont, NY (US)

( * ) Notice: Subject to any disclaimer, the term of this patent is extended or adjusted under 35 U.S.C. 154(b) by 0 days.

(21) Appl. No.: 15/447,660

(22) Filed: Mar. 2, 2017

(65) Prior Publication Data

US 2018/0128467 A1 May 10, 2018

Related U.S. Application Data

(63) Continuation-in-part of application No. 29/587,568, filed on Dec. 14, 2016, now Pat. No. Des. 791,400.

(60) Provisional application No. 62/419,505, filed on Nov. 9, 2016.

(51) Int. Cl.

| | |
|---|---|
| ***F21S 2/00*** | (2016.01) |
| ***F21S 8/06*** | (2006.01) |
| ***F21V 21/35*** | (2006.01) |
| ***F21V 23/02*** | (2006.01) |
| ***F21V 21/005*** | (2006.01) |
| ***F21V 21/104*** | (2006.01) |

(52) U.S. Cl.

CPC ..... *F21V 21/35* (2013.01); *F21S 2/005* (2013.01); *F21S 8/063* (2013.01); *F21V 21/005* (2013.01); *F21V 21/104* (2013.01); *F21V 23/02* (2013.01)

(58) Field of Classification Search

CPC .... F21S 8/02; F21S 6/003; F21S 10/00; F21S 8/063; F21S 8/038; F21S 8/066; F21Y 2103/00; F21V 21/04; F21V 21/35

USPC ..... 362/147, 148, 150, 249.1

See application file for complete search history.

(56) References Cited

U.S. PATENT DOCUMENTS

| | | | |
|---|---|---|---|
| 2,292,395 | A | 8/1942 | O'Brien |
| D217,785 | S | 6/1970 | Wolff |
| D222,748 | S | 12/1971 | Strianese |
| 3,716,031 | A | 2/1973 | Rowbury |
| 3,748,463 | A | 7/1973 | Trassinelli |
| 4,723,747 | A | 2/1988 | Karp |
| 4,758,935 | A | 7/1988 | Frassati et al. |

(Continued)

FOREIGN PATENT DOCUMENTS

| | | |
|---|---|---|
| CN | 200 986 123 Y | 12/2007 |
| CN | 205261379 U | 5/2016 |

(Continued)

OTHER PUBLICATIONS

Non-Final Office Action dated Dec. 6, 2017 issued in corresponding U.S. Appl. No. 15/446,302.

(Continued)

*Primary Examiner* — Alexander K Garlen

(74) *Attorney, Agent, or Firm* — Gottlieb, Rackman & Reisman, P.C.

(57) ABSTRACT

A hanger for supporting the ends of two in-line power bars that includes a body with two cavities that are configured to receive the respective ends of the power bars. Clips within the cavities engage rails in the power bars. One or more rods extend from the hanger to support the hanger body and can also be electrically connected to the clips.

12 Claims, 19 Drawing Sheets

(56) References Cited

U.S. PATENT DOCUMENTS

| | | | | |
|---|---|---|---|---|
| 4,763,870 | A | 8/1988 | Wodlinger | |
| D301,304 | S | 5/1989 | Will | |
| D317,058 | S | 5/1991 | Sonneman | |
| 5,025,355 | A | 6/1991 | Harwood | |
| D320,465 | S | 10/1991 | Sonneman | |
| 5,065,295 | A | 11/1991 | De La Haye et al. | |
| 5,105,349 | A | 4/1992 | Falls | |
| D360,046 | S | 7/1995 | Sugiura | |
| 5,440,469 | A | 8/1995 | Gomes | |
| 5,455,754 | A | 10/1995 | Hoffner | |
| 5,584,576 | A | 12/1996 | Wei Hong | |
| D392,407 | S | 3/1998 | Johnson et al. | |
| 5,833,358 | A | 11/1998 | Patik | |
| 6,135,615 | A | 10/2000 | Lee | |
| 6,179,442 | B1 | 1/2001 | Schurle | |
| 6,241,369 | B1 | 6/2001 | Mackiewicz | |
| 6,244,733 | B1 | 6/2001 | Fong et al. | |
| 6,341,979 | B1 | 1/2002 | Yamamoto | |
| 6,409,524 | B1 | 6/2002 | Miller et al. | |
| 6,489,748 | B1 | 12/2002 | Okamura | |
| 6,659,623 | B2 | 12/2003 | Friend | |
| 6,769,790 | B2 | 8/2004 | Fruhm | |
| D507,374 | S | 7/2005 | Chen | |
| 7,172,332 | B2 * | 2/2007 | Mobarak | F21V 21/35 362/147 |
| 7,246,935 | B2 | 7/2007 | Benghozi et al. | |
| 7,397,384 | B1 | 7/2008 | MacKenzie, IV | |
| 7,503,778 | B2 | 3/2009 | Lehman et al. | |
| 7,507,005 | B1 | 3/2009 | Mier-Langner | |
| 7,520,762 | B2 | 4/2009 | Lehman et al. | |
| 7,520,763 | B1 | 4/2009 | Buse | |
| 7,527,406 | B2 * | 5/2009 | Kwon | G02F 1/133604 362/23.15 |
| D595,884 | S | 7/2009 | Liao | |
| 7,563,000 | B2 | 7/2009 | Gierveld | |
| 7,571,736 | B1 | 8/2009 | Chu | |
| 7,654,834 | B1 | 2/2010 | Imier-Langner et al. | |
| D611,169 | S | 3/2010 | Harder | |
| D620,168 | S | 7/2010 | Sabernig | |
| 7,794,132 | B2 | 9/2010 | Cunius | |
| 7,798,824 | B2 * | 9/2010 | Fong | H01R 33/22 362/147 |
| 7,806,913 | B2 | 10/2010 | Fanger | |
| D629,954 | S | 12/2010 | Compton | |
| D632,423 | S | 2/2011 | Canfield | |
| 7,955,125 | B1 | 6/2011 | Petrillo | |
| D648,470 | S | 11/2011 | Rains | |
| D649,692 | S | 11/2011 | Trzesniowski | |
| 8,061,865 | B2 | 11/2011 | Piepgras et al. | |
| D671,670 | S | 11/2012 | Sonneman | |
| 8,398,276 | B2 | 3/2013 | Pearson et al. | |
| D680,673 | S | 4/2013 | Levine | |
| D689,221 | S | 9/2013 | Isaac | |
| 8,523,378 | B2 * | 9/2013 | Schulzman | F04D 25/088 362/147 |
| 8,584,412 | B2 | 11/2013 | Frecska et al. | |
| 8,616,871 | B2 | 12/2013 | Galomb | |
| 8,733,710 | B1 | 5/2014 | Suazo | |
| 8,794,804 | B2 | 8/2014 | Verfuerth | |
| 8,814,383 | B2 | 8/2014 | Bizzotto et al. | |
| 8,840,319 | B2 | 9/2014 | Hogue | |
| 8,967,573 | B2 | 3/2015 | Hemmer | |
| D739,070 | S | 9/2015 | Wilson | |
| 9,136,659 | B2 | 9/2015 | Fishman et al. | |
| D747,636 | S | 1/2016 | Maher | |
| 9,387,268 | B2 | 7/2016 | Farren | |
| D765,296 | S | 8/2016 | Wei | |
| 9,464,772 | B2 * | 10/2016 | O'Brien | F21S 8/066 |
| 9,472,912 | B2 | 10/2016 | Schirmeier | |
| D772,467 | S | 11/2016 | Sonneman | |
| D772,475 | S | 11/2016 | Sonneman | |
| D773,099 | S | 11/2016 | Sonneman | |
| D773,101 | S | 11/2016 | Sonneman | |
| D773,715 | S | 12/2016 | Sonneman | |
| D773,719 | S | 12/2016 | Sonneman | |
| D773,725 | S | 12/2016 | Sonneman | |
| D775,397 | S | 12/2016 | Sonneman | |
| D779,113 | S | 2/2017 | Sonneman | |
| D779,437 | S | 2/2017 | Sonneman | |
| D779,712 | S | 2/2017 | Sonneman | |
| D779,713 | S | 2/2017 | Sonneman | |
| D779,714 | S | 2/2017 | Sonneman | |
| D779,715 | S | 2/2017 | Sonneman | |
| D782,990 | S | 4/2017 | Sonneman | |
| 9,618,172 | B1 | 4/2017 | Means | |
| 9,739,460 | B2 | 8/2017 | Haubach | |
| 9,765,954 | B2 | 9/2017 | Zaderej et al. | |
| 2003/0031018 | A1 | 2/2003 | Bray et al. | |
| 2003/0103347 | A1 | 6/2003 | Friend | |
| 2004/0005798 | A1 | 1/2004 | Lin | |
| 2004/0160767 | A1 | 8/2004 | Mobarak et al. | |
| 2005/0207173 | A1 * | 9/2005 | Benghozi | H01R 25/142 362/404 |
| 2007/0053209 | A1 | 3/2007 | Uhler et al. | |
| 2007/0115694 | A1 | 5/2007 | Mobarak et al. | |
| 2007/0247845 | A1 | 10/2007 | Udo | |
| 2008/0190043 | A1 * | 8/2008 | Beckmann | A47H 21/00 52/64 |
| 2009/0051292 | A1 | 2/2009 | Noh | |
| 2009/0123994 | A1 | 5/2009 | Lafaye et al. | |
| 2010/0271834 | A1 | 10/2010 | Muessli | |
| 2010/0271847 | A1 | 10/2010 | Mobarak et al. | |
| 2012/0257388 | A1 | 10/2012 | Bracher et al. | |
| 2013/0279180 | A1 | 10/2013 | Pearson et al. | |
| 2014/0226315 | A1 | 8/2014 | Nicieja et al. | |
| 2015/0198311 | A1 | 7/2015 | O'Brien et al. | |
| 2015/0316238 | A1 | 11/2015 | Guilmette | |
| 2015/0338037 | A1 | 11/2015 | Wang et al. | |
| 2016/0033098 | A1 | 2/2016 | Bergman et al. | |
| 2017/0184290 | A1 | 6/2017 | Chiu | |
| 2017/0198892 | A1 | 7/2017 | Sonneman | |
| 2018/0160891 | A1 | 6/2018 | Ahearn | |

FOREIGN PATENT DOCUMENTS

| | | | |
|---|---|---|---|
| DE | 8708815 | U1 | 11/1987 |
| DE | 4414046 | A1 | 10/1995 |
| DE | 29705852 | U1 | 5/1997 |
| DE | 19849101 | A1 | 4/1999 |
| DE | 202004001178 | U1 | 5/2004 |
| EP | 0320661 | A2 | 6/1989 |
| EP | 0379244 | A1 | 7/1990 |
| EP | 0734108 | A2 | 9/1996 |
| EP | 1757858 | A2 | 2/2007 |
| EP | 1847763 | A1 | 10/2007 |
| EP | 2821695 | A1 | 1/2015 |
| EP | 3196547 | A1 | 7/2017 |
| FR | 608 016 | A | 7/1926 |
| FR | 2588713 | A1 | 4/1987 |
| WO | 2016/132361 | A1 | 8/2016 |
| WO | 2016/150564 | A2 | 9/2016 |

OTHER PUBLICATIONS

Non-Final Office Action dated Dec. 22, 2017 issued in corresponding U.S. Appl. No. 15/584,171.

Final Office Action dated Dec. 29, 2017 issued in corresponding U.S. Appl. No. 15/287,897.

Non-Final Office Action dated Jan. 12, 2018 issued in corresponding U.S. Appl. No. 15/801,855.

Non-Final Office Action dated Jan. 11, 2018 issued in corresponding U.S. Appl. No. 15/801,893.

Non-Final Office Action dated Jan. 11, 2018 issued in corresponding U.S. Appl. No. 15/808,109.

EPO, Extended European Search Report dated Jan. 3, 2018 issued in corresponding European Patent Application No. 17200563.9.

EPO, Extended European Search Report dated Jan. 5, 2018 issued in corresponding European Patent Application No. 17200550.6.

Non-Final Office Action dated Jan. 17, 2018 issued in corresponding U.S. Appl. No. 15/427,217.

(56) References Cited

OTHER PUBLICATIONS

EPO, Extended European Search Report dated Mar. 27, 2018 issued in corresponding European Patent Application No. 17200553.0 filed Nov. 8, 2017.
EPO, Extended European Search Report dated Mar. 28, 2018 issued in corresponding European Patent Application No. 17200535.7 filed Nov. 8, 2017.
EPO, Extended European Search Report dated Mar. 28, 2018 issued in corresponding European Patent Application No. 17200541.5 filed Nov. 8, 2017.
EPO, Partial European Search Report dated Apr. 24, 2018 issued in corresponding European Patent Application No. 17200544.9 filed Nov. 8, 2017.
EPO, Extended European Search Report dated Aug. 7, 2018 issued in corresponding European Patent Application No. 17200544.9 filed Nov. 8, 2017.
CIPO, First Office Action dated Sep. 25, 2018 issued in corresponding Canadian Patent Application No. 2,984,651 filed Nov. 2, 2017.
CIPO, First Office Action dated Sep. 25, 2018 issued in corresponding Canadian Patent Application No. 2,984,672 filed Nov. 2, 2017.
USPTO, Non-Final Office Action dated Jan. 13, 2017 issued in corresponding U.S. Appl. No. 15/251,369.
USPTO, Non-Office Action dated Mar. 3, 2017 issued in corresponding U.S. Appl. No. 15/255,289.
USPTO, Non-Final Office Action dated Mar. 7, 2017 issued in corresponding U.S. Appl. No. 15/287,897.
USPTO, Non-Final Office Action dated Feb. 10, 2017 issued in corresponding U.S. Appl. No. 15/286,977.
USPTO, Non-Final Office Action dated Mar. 1, 2017 issued in corresponding U.S. Appl. No. 15/378,207.
USPTO, Non-Final Office Action dated Dec. 22, 2016 issued in corresponding U.S. Appl. No. 15/197,919.
USPTO, Final Office Action dated Apr. 5, 2017 issued in corresponding U.S. Appl. No. 15/197,919.
EPO, Extended European Search Report dated Jun. 26, 2017 issued in corresponding European Patent Application No. 171506868.8.
USPTO, Non-Final Office Action dated Aug. 18, 2017 issued in corresponding U.S. Appl. No. 15/584,171.
USPTO, Non-Final Office Action dated Sep. 27, 2017 issued in corresponding U.S. Appl. No. 15/407,085.
USPTO, Final Office Action dated Jun. 6, 2017 issued in corresponding U.S. Appl. No. 15/251,369.
USPTO, Non-Final Office Action dated Sep. 7, 2017 issued in corresponding U.S. Appl. No. 15/287,897.

* cited by examiner

POWER BAR HANGER FOR MODULAR LIGHTING SYSTEM

CROSS-REFERENCE TO RELATED APPLICATIONS

This application claims priority to U.S. Provisional Application No. 62/419,505, filed Nov. 9, 2016, and is a continuation-in-part of U.S. Design patent application No. 29/587,568, filed on Dec. 14, 2016, the contents of which are incorporated herein by reference in their entirety.

FIELD OF THE INVENTION

This invention pertains generally to a modular lighting system and more specifically to a modular lighting system that includes power bars and a connector where the connector is configured to support and interconnect two power bars in a modular lighting system and, optionally, to provide power thereto.

BACKGROUND OF THE INVENTION

Designing a lighting system for a space has always been a challenge because the lighting system has to meet utilitarian, technical and aesthetic needs. Thus, any such endeavor is successful only if technical, architectural and artistic skills are combined.

Several different types of ceiling lights are presently available, including surface mounted lights, recessed lights and hanging lights. The present invention pertains to hanging lights.

SUMMARY OF THE INVENTION

In general, the present invention is directed to a modular lighting system that is configured to provide light in a space. The modular lighting system can include canopies that are connectable to a power source, a plurality of power bars, a plurality of hangers, including a first set of hangers that support the power bars from the canopy and a second set of hangers that support a plurality of pendants. The hangers and the power bars cooperate to provide electric power to the pendants from the canopy.

More specifically, the present disclosure is directed to a hanger for supporting and simultaneously interconnecting a first end of a first power bar and a first end of a second power bar of a modular lighting system such that the power bars are orientated in line with each other by the hanger. Each of the first power bar and the second power bar include a first rail and a second rail that is spaced from the first rail that are configured to deliver power to pendants of the modular lighting system. The hanger comprises a body that includes base, a first sidewall that extends from a first side of the base, a second sidewall that is spaced from the first sidewall and extends from a second side of the base and a third sidewall that extends traverse between the first sidewall and the second sidewall to form a first cavity that is configured to receive one of the first end of one of the first power bar and the second power bar and a second cavity that is configured to receive one of the first end of the other of the first end of the first power and the second power bar. A first set of clips are disposed in the first cavity that are adaptable to form an interference fit with the first rail and the second rail of one of the first bar and the second power bar and a second set of clips, which are independent of and spaced from the first set of clips, are disposed in the second cavity that are adaptable to form an interference fit with the first rail and the second rail of one of the first power bar and the second power bar. A rod attached to and extends upwardly from the body. The rod can be electrically insulated from the clips and can extend from the third sidewall.

Preferably, each power bar includes two bar segments facing each other and being made of a non-conductive material. Conductive rails are provided on the inner surface of each power bar segment. The hanger is configured to form an interference fit with the bar segments.

The hanger can include at least one connector element electrically connecting one of the clips of the first set of clips to one of the clips of the second set of clips.

The hanger can include a first inner wall that is disposed in the first cavity and a second inner wall that is disposed in the second cavity with the first set of clips attached to the first inner wall and the second set of clips attached to the second inner wall.

The first set of clips and the second set of clips can be electrically insulated.

In another embodiment, the present disclosure is directed to a hanger for supporting a first end of a first power bar and a first end of a second power bar of a modular lighting system. The first power bar and the second power bar are disposed in line with each other and each include a first longitudinally extending rail and a second longitudinally extending rail that is spaced from the first rail. The first rail and the second rail are configured to support and provide power to pendants of the modular lighting system. The hanger comprises a body that includes base that has a first sidewall extending from a first side of the base, a second sidewall that is spaced from the first sidewall, extending from a second side of the base and a third sidewall extending traverse between the first sidewall and the second sidewall forming a first cavity that is configured to receive one of a first end of the first power bar and a first end of the second power bar and a second cavity that is independent of the first cavity and is configured to receive the other of the first end of the first power bar and the first end of the second power bar. A first protrusion extends from the base and is disposed in the first cavity. The first protrusion has a first surface and a second surface that is opposed the first surface and a second protrusion that extends from the base and is disposed in the second cavity. The second protrusion has a first surface and a second surface that is opposed the first surface. A first set of clips, including a first clip and a second clip, are disposed on the first surface and the second surface, respectively, of the first protrusion and a second set of clips, including a first clip and a second clip, are disposed on the first surface and the from the body.

The first set of clips and the second set of clips can be electrically insulated from each other.

The hanger can include a first connecting element connecting one of the first clip and the second clip of said first set of clips to one of the first clip and the second clip of one of the first clip and the second clip of the second set of clips. The hanger can include a second connecting element connecting the other one of the first clip and the second clip of said first set of clips to the other one of the first clip and the second clip of said second set of clips.

The rod can be electrically connected to one of the first set of clips and the second set of clips. The rod can be electrically connected to the first connecting element. The hanger can include a second rod that is electrically connected to the second connecting element. The rod(s) can be electrically insulated from the clips. In an embodiment, two conductive parallel rods or cables can be in electrical contact with the rails of the power bars through the respective bases of the hangers. In another embodiment, two rods extend upwardly from body and are electrically connected to the clips. The power can be provided either through one of the power bars to the hanger or from the two rods.

These various elements are combined in many different ways resulting in a virtually infinite number of configurations. One configuration may include several power bars disposed in a vertical plane. In another class of configurations, several bars extend at different angles in one plane and are joined at a common point. Another configuration may include a combination of the previously mentioned configurations. Yet another configuration may include several power bars disposed at different heights or tiers with some of the power bars being perpendicular to other power bars.

BRIEF DESCRIPTION OF THE DRAWINGS

FIG. 2;

DETAILED DESCRIPTION OF EMBODIMENTS OF THE INVENTION

With reference now to the drawings, and in particular FIGS. 1-6C, embodiments of elements of modular lighting systems of the present invention will be described.

In general, each modular lighting system of the present disclosure includes one or more canopies, a plurality of hangers, a plurality of power bars and a plurality of pendants. The hangers can include (1) parallel hangers and/or (2) perpendicular hangers. Parallel hangers are used to support one power bar beneath another in parallel. Perpendicular hangers are used to support one power bar from another that extend perpendicular to each other. Hangers can support power bars from canopies, power bars from ceilings without a power connection and pendants. As will be described in detail below, each hanger must be able to interface with a power bar at at least one end. In addition, some systems may include connectors.

Unless otherwise noted, all the hangers and all power bars include two interconnected elements.

Figure 1:
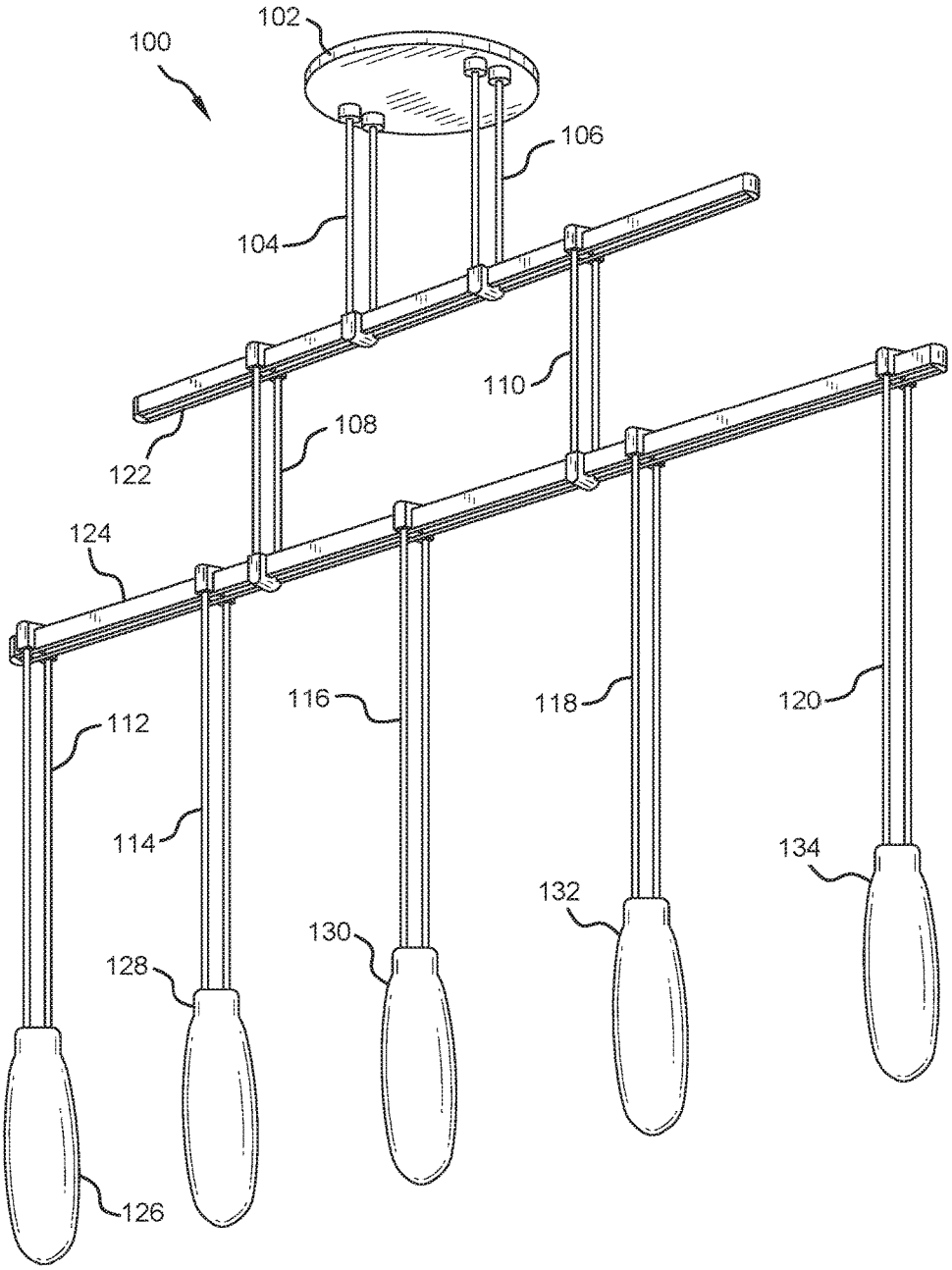
FIG. 1 is a perspective view of an embodiment of a modular lighting system.

FIG. 1 shows an embodiment of a modular lighting system 100 that includes a canopy 102 that supports the modular lighting system 100 from a ceiling or other similar architectural member in a conventional manner. In this case, the canopy 102 also provides power to the modular lighting system 100. Other, lighting systems may have several canopies that support such systems and only some or only one canopy may also provide power. Here, the canopy 102 includes a conventional power supply connected to standard AC lines that provide power to light-emitting diode (LED) tubes in pendants 126, 128, 130, 132, 134 as discussed below. The power supply is hidden.

Two power feed hangers 104, 106 extend downwardly from the canopy 102. In an embodiment, each hanger discussed hereinafter includes two solid bars or rods. In another embodiment (not shown), the power feed hangers 104, 106 are replaced by multi-strand twisted steel cables.

In FIG. 1 the power feed hangers 104, 106 are used to support a power bar 122. Two additional power feed hangers 108, 110 are interconnected with the power bar 122 and used to support a second power bar 124.

Pendant hangers 112, 114, 116, 118, 120 are used to support a plurality of pendants 126, 128, 130, 132, 134. The pendants 126, 128, 130, 132, 134 preferably include LED bulbs that run on 24 VAC.

Preferably, one of the power feed hangers 106, which includes two hanger segments that are connected to a transformer disposed within the canopy 102. In an embodiment, power from the power feed hanger 106 flows through the first power bar 122, the hanger 110, the second power bar 124 and the hangers 112, 114, 116, 118, 120 to the pendants, 126, 128, 130, 132, 134, respectively. The transformer steps down the line voltage from a standard power line to 24 VAC for the pendants 126, 128, 130, 132, 134. The other power feed hanger 104 may be electrically floating. Thus, in this embodiment, all of the power bars 122, 124 carry power, but only some of the hangers 104, 106, 108, 110, 112, 114, 116, 118, 120 carry power.

Figure 2:
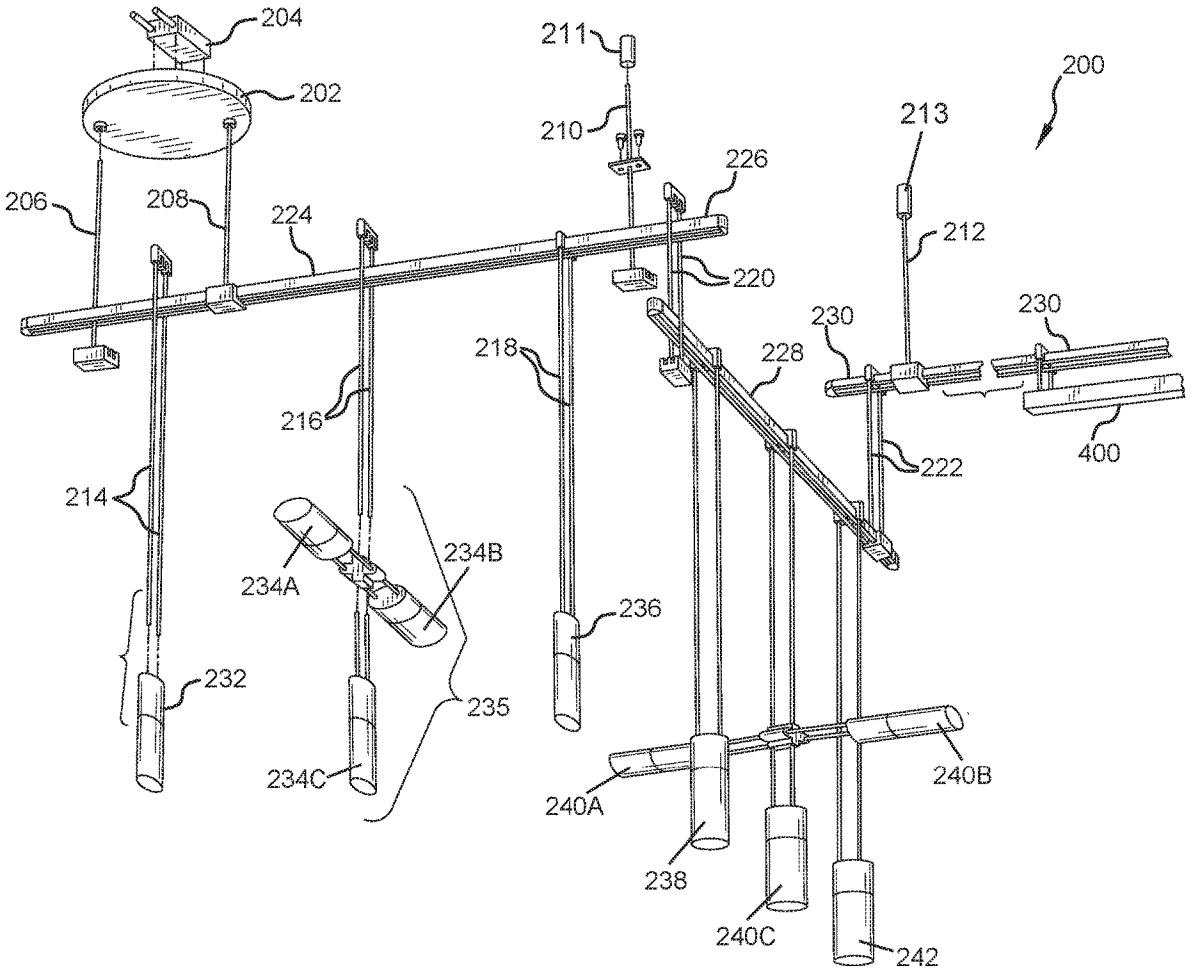
FIG. 2 is a perspective view of another embodiment of a modular lighting system.

FIG. 2 shows an embodiment of another modular lighting system 200. This system 200 includes a canopy 202 with a transformer 204. Attached to the canopy 202 by two hangers 206, 208 is a first power bar 224. As opposed to the hangers 104, 106, 108, 110, 112, 114, 116, 118, 120 of FIG. 1, these hangers 206, 208 have a single extended element, such as a rod. Each of the hangers 206, 208 provide power to one of the elements of the first power bar 224. However, because the first power bar 224 is not centered below the canopy 202, but extends in one direction away therefrom, another hanger 210, which may be referred to as a ceiling hanger, is used to support a distal end 226 of the first power bar 224. At its top, the hanger 210 is attached to a sleeve 211 that is secured to the ceiling in a conventional manner.

Hangers 214, 216, 218 are used to attach respective pendants 232, 234A, 234B, 234C, 236 from the first power bar 224 with one of the hangers 216 being used to support a cluster of pendants 235.

The modular lighting system 200 includes a second power bar 228 that is supported at one end by a hanger 220 that extends near the distal end 226 of the first power bar 224. The hanger 220 also provides power to the second power bar 228. A third power bar 230 is supported from the ceiling by ceiling hangers 212 attached to a sleeve 213 (only one such ceiling hanger is being shown in FIG. 2 for the sake of clarity. The third power bar 230 supports the second end of the second bar 228 by a hanger 222 that extends from the third power bar 203 and the second power bar 228 receives power from the transformer 204 through the hanger 220 which is transferred to a plurality of pendants 238, 240A, 240B, 240C, 242. Each of the power bars 224, 228, 230 can be used to hang pendants of various sizes and shapes and arranged in different configurations as desired. For example, a linear light bar 400 can be disposed below the third power bar 230 and is configured to direct light downward.

FIGS. 3A-3K show details of an embodiment of a power bar 300. Unless otherwise noted, all of the power bars discussed previously and subsequently have the same configuration. The power bar 300 is merely a representative power bar of those described herein. In FIGS. 3A-3K, the power bar 300 is shown as being straight. However the power bar 300 can be circular ellipsoid or another geometric shape. The power bar 300 includes two identical longitudinal segments, or rails 302, 304, that include inner surfaces that face each other.

Figure 3A:
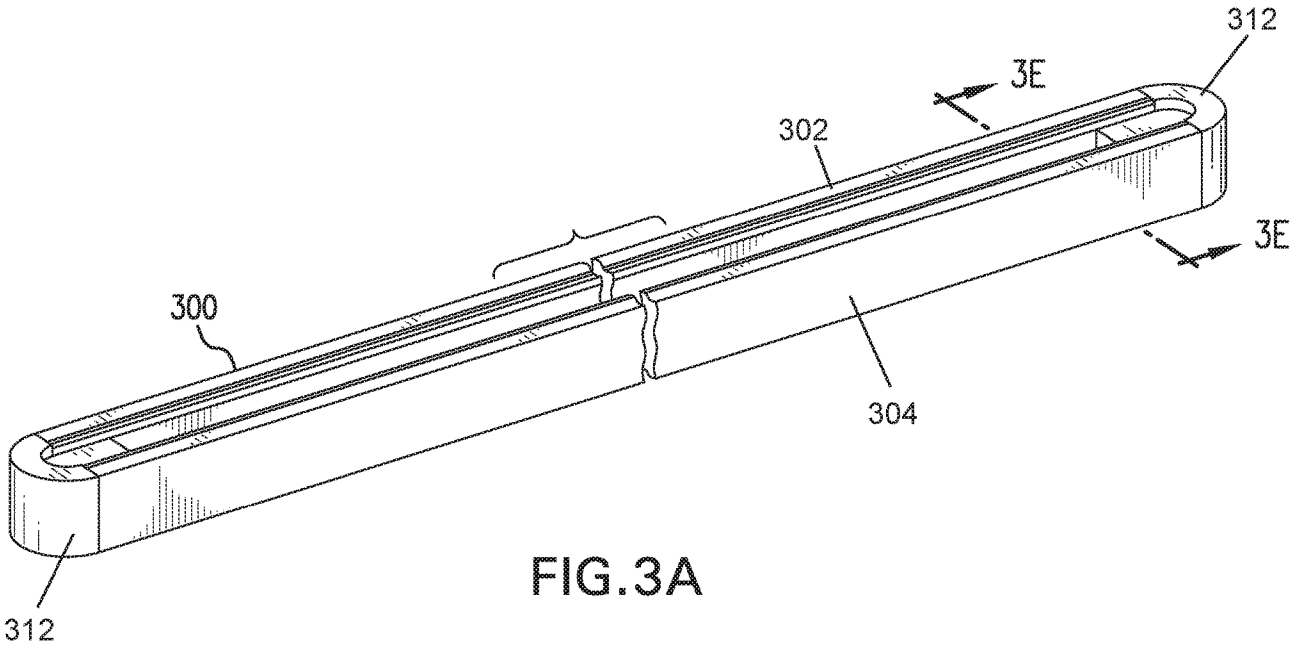
FIGS. 3A-3K are various views showing features of a power bar that can be used in the modular lighting system of FIG. 1 or FIG. 2.
Figure 3B:
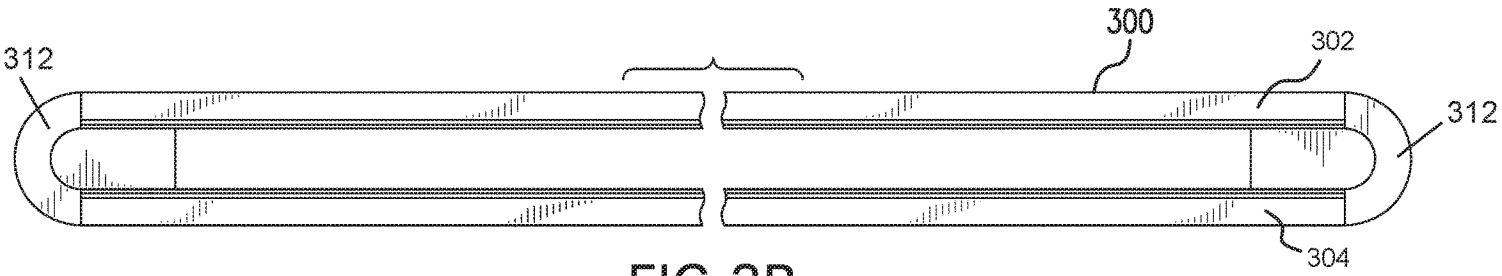
Figure 3C:
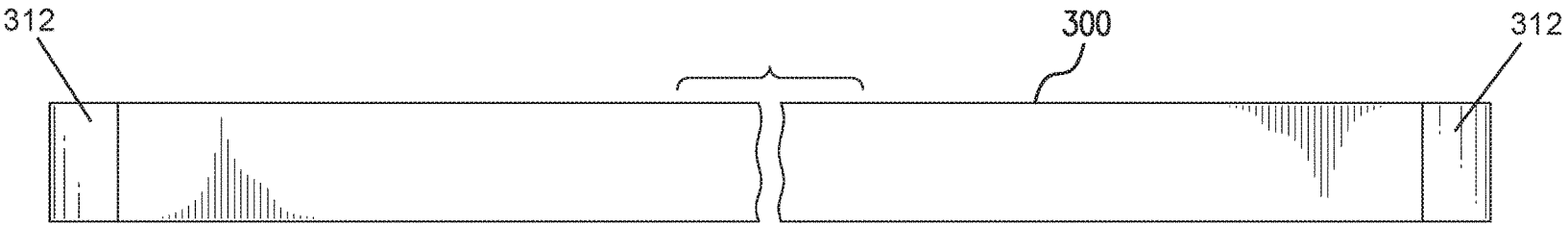
Figure 3E:
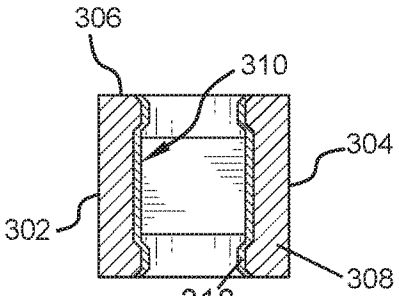
Figure 3D:
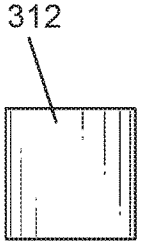
Figure 3F:
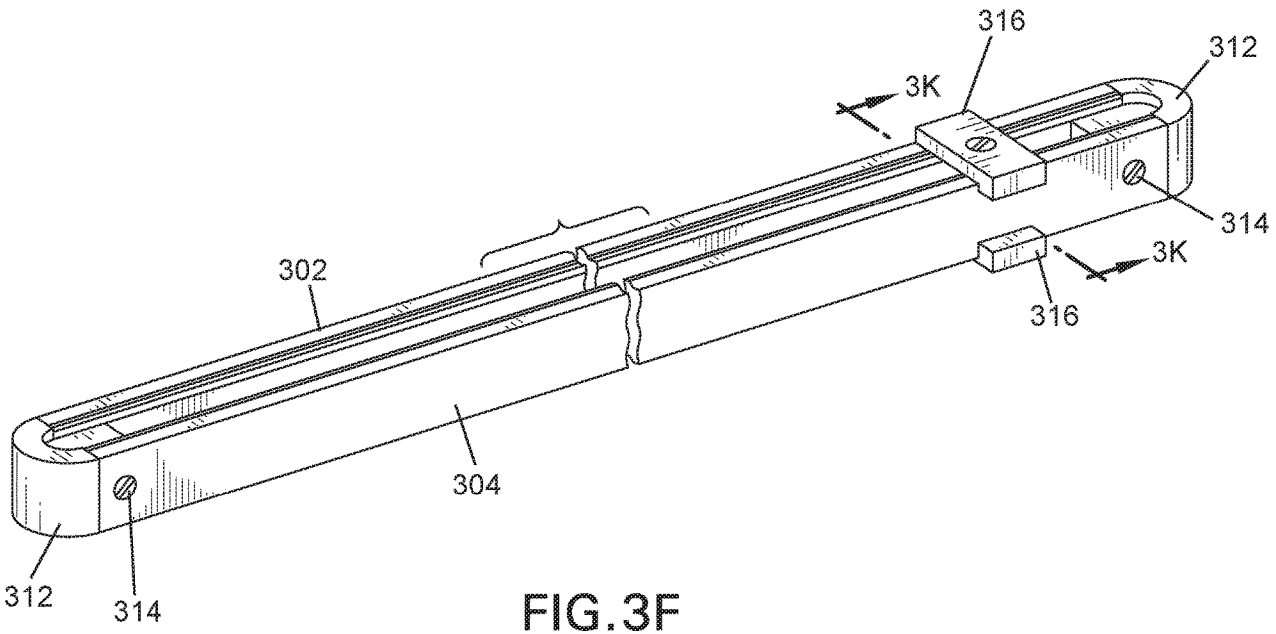
Figure 3G:
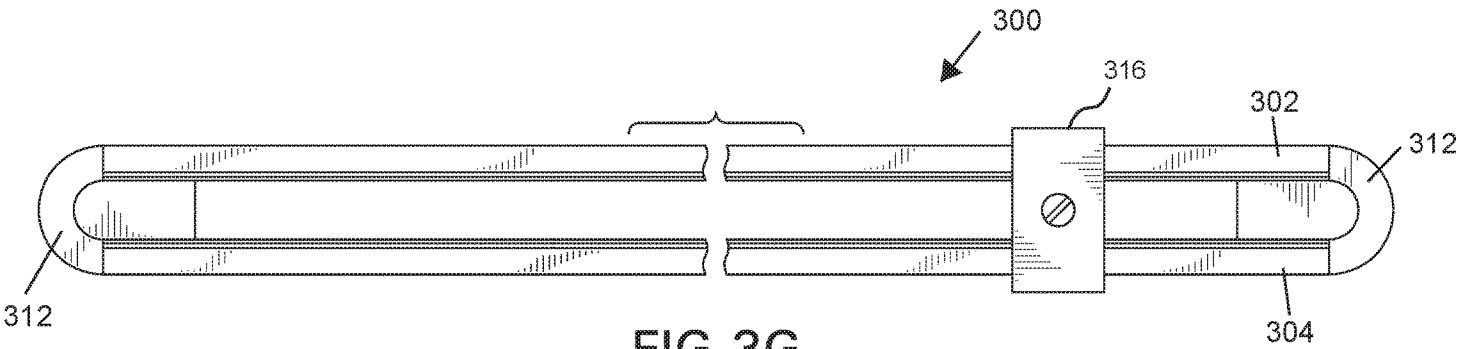
Figure 3H:
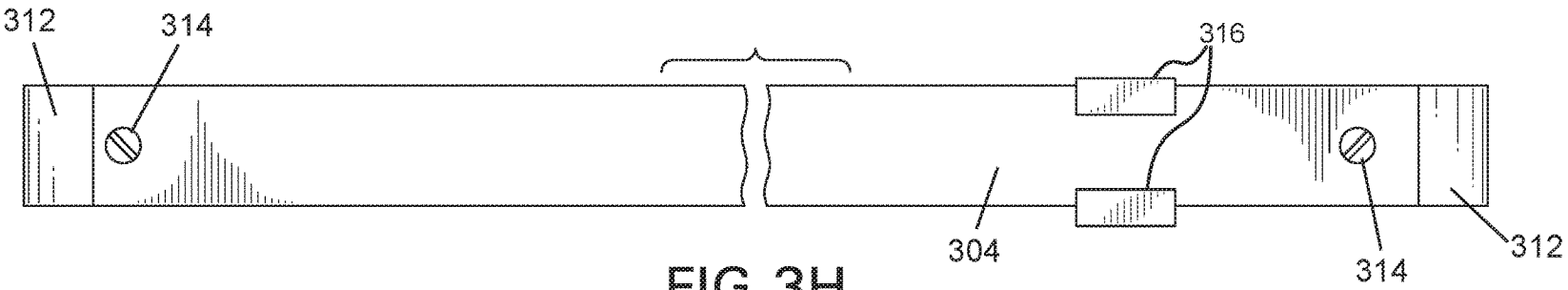
Figure 3K:
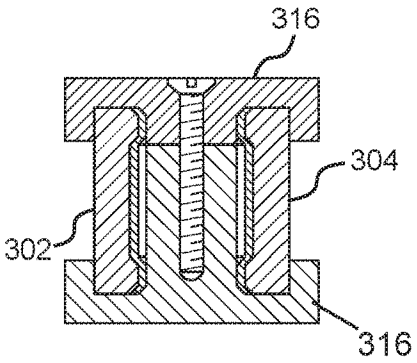
Figure 3J:
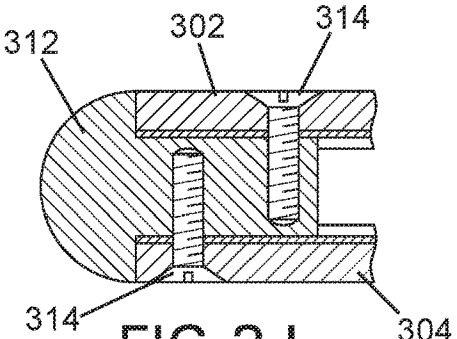
Figure 3I:
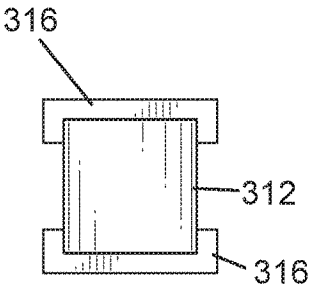

A cross-sectional view of the power bar 300 is seen in FIG. 3E. Each rail 302, 304 includes a C-shaped main body 306, 308, respectively, made of a non-conductive material, such as a plastic material that is light weight, but strong so that it can support various pendants, other bars, etc. and channels 310 that are made of a light weight conductive material such as aluminum and embedded into the inside surface of each rail 302, 304. Preferably, each rail 302, 304 includes a rectangular channel. The rails 302, 304 are joined together at each end by an end connector 312. The connectors 312 are attached to the rails 302, 304 by conventional means, such as screws 314, by an adhesive or other means.

Preferably, the two segments 302, 304 have inner surfaces spaced at a nominal distance throughout the length of the power bar 300. The power bar 300 is made in standard lengths ranging from to 12 to 48 inches. As shown, for example, in FIGS. 3H to 3K, for very long power bars, for example in excess of 24 inches, a spacer 316 is placed between the segments 302, 304. The spacer 316 may be held in place by screws or other means.

FIGS. 4A-4G show details of parallel hanger, such as hanger 110 from FIG. 1. The hanger 110 includes two vertical segments 111A, 111B. At the top and the bottom ends, the two segments 111A, 111B imbedded in identical W-shaped bases 113, which are shown in more detail in FIGS. 4B-4G.

The base 113 forms two channels 115, 117 with a wall 113C separating the two channels 115, 117. Two metallic springs or clips 119, 121 extend outwardly from the base 113 into the channels 115, 117. One of the clips 119 is electrically attached to the first segment 111A within the base 113, and the other clip 121 is connected to the second segment 111B. Preferably, the base 113 is made of a non-conductive material and is overmolded to cover portions of the clips 119, 121 and segments 111A, 111B. In one embodiment, two bases 113 form a single, unitary structure. In another embodiment, at least the top base 113 is made of two sections 113A, 113B that snap together forming an interference fit therebetween.

Figure 4A:
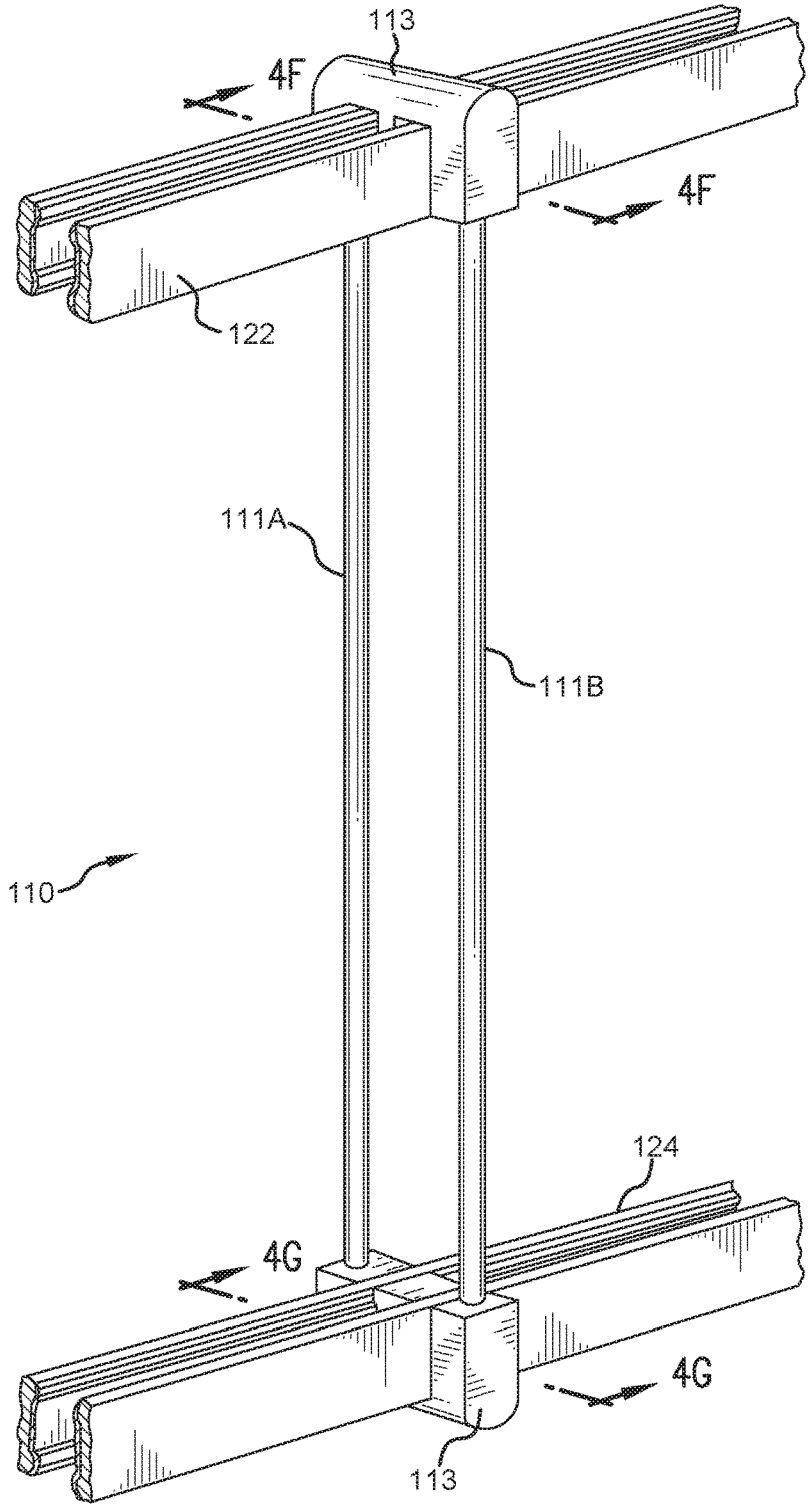
FIGS. 4A-4J are various views showing features of hangers used in the system of FIG. 1.
Figure 4C:
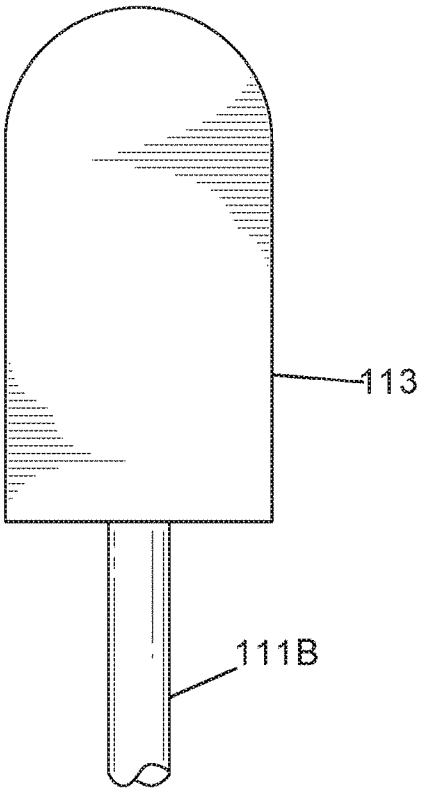
Figure 4B:
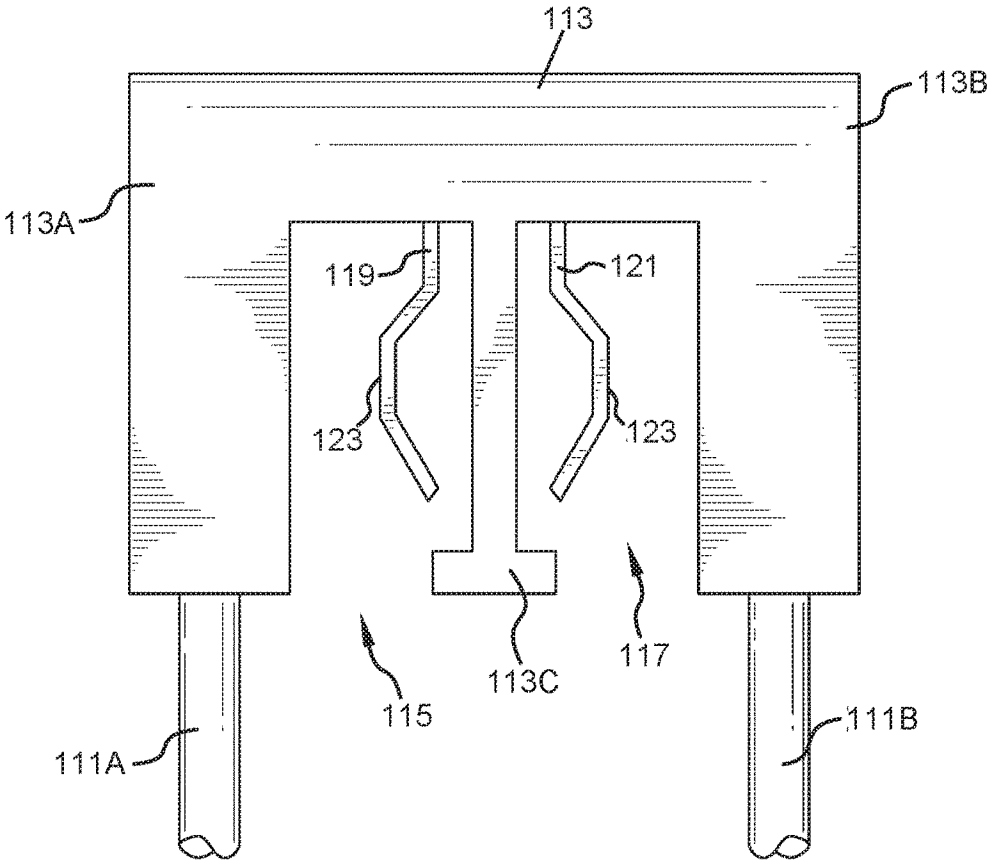
Figure 4D:
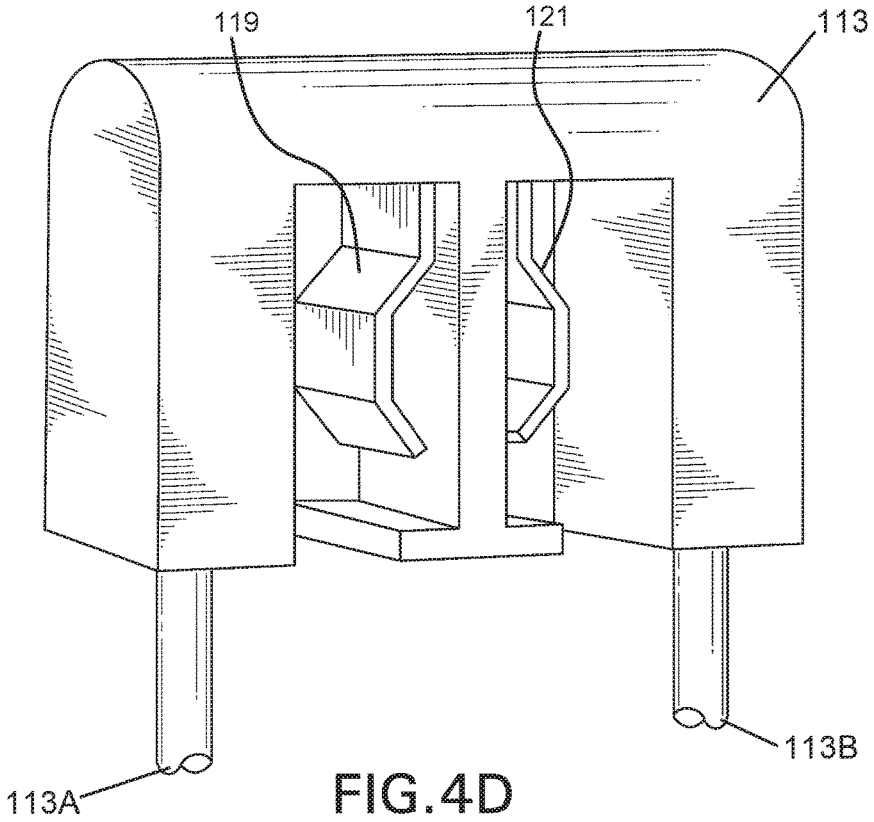
Figure 4E:
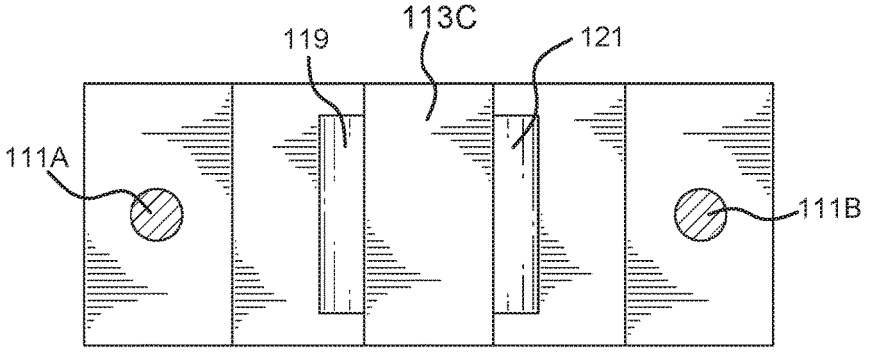
Figure 4F:
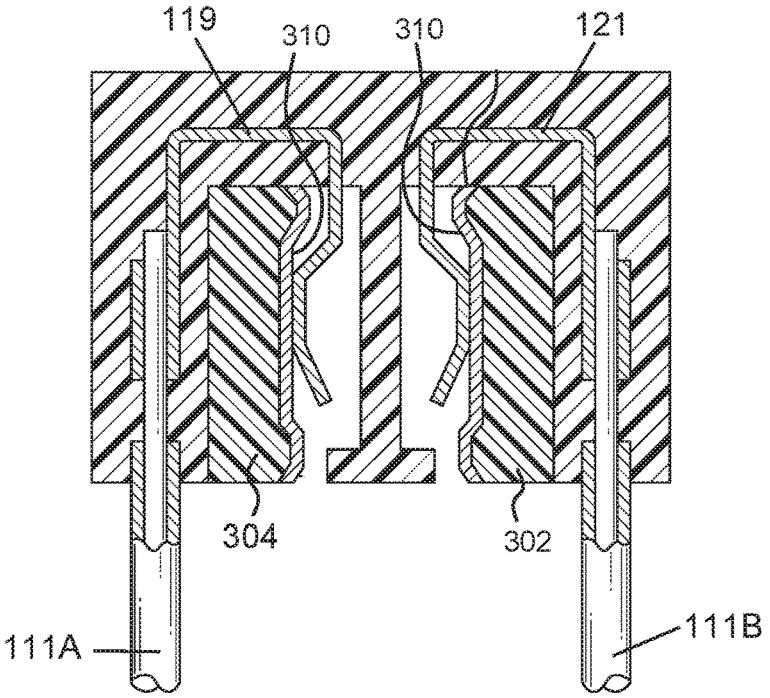
Figure 4G:
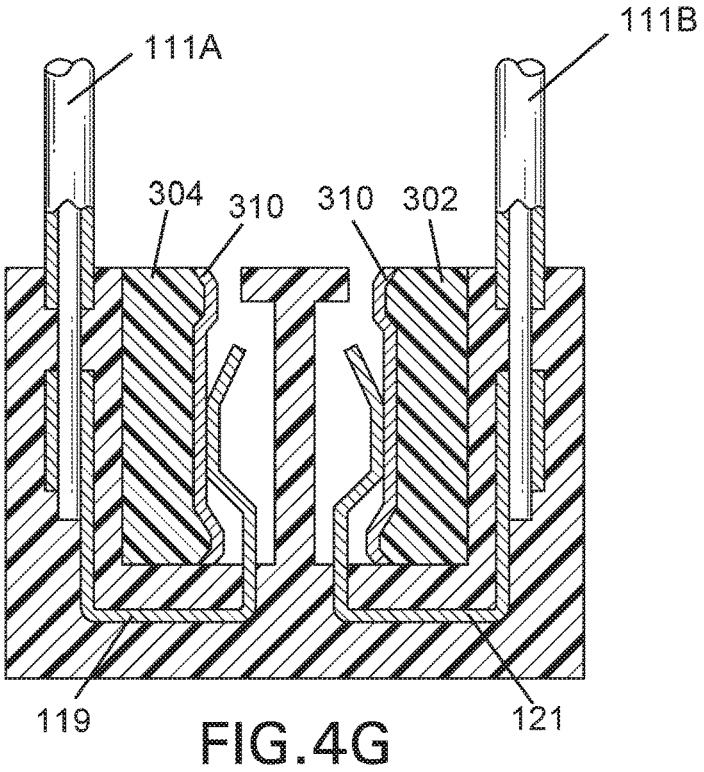

As can be seen in FIGS. 4F and 4G, the bases 113 are sized and shaped so that they fit over and engage the rails of a power bar. Here, for example, the bases 113 engage the rails 302, 304 of the generic power bar 300. Importantly, the clips 119, 121 are sized and shaped so that they engage the rails. The clips 119, 121 have a flat section 123 sized and shaped to snap into the channels 306, 308 of the rails 302, 304, respectively. In this manner not only do the clips 119, 121 provide a solid electrical contact with the rails 302, 304, but they also stabilize the hangers on the power bars (as shown in FIG. 4A, power bars 122, 124) and ensure that the lower power bar (as shown in FIG. 4A, for example, power bar 124) remains stiff and does move around in use. The clips may be made from beryllium copper.

The clips 119, 121 need not be connected electrically to the hanger segments. However, in other situations, for example, in the configuration shown in FIG. 2, the hangers 220 can provide an electrical connection to the power bars 228 and 230.

The hanger segments 111A, 111B are provided in various lengths as required to obtain the various systems described above, and they are preferably made in the shape of rods of a stiff, but somewhat springy material having shape memory such as a phosphor/bronze alloy. Preferably, except where an electrical contact is required, the rods are covered or painted with a thin electrically insulating material.

In an embodiment, a power bar, for example, power bar 300, can be connected to the housing 113 by separating the two segments 111A, 111B, passing a first power bar and a second power bar between the segments 111A, 111B, then lowering or raising the power bars toward the respective bases 113 and then snapping the bases 113 onto the power bars into the configurations shown in FIGS. 4F and 4G.

Figure 4H:
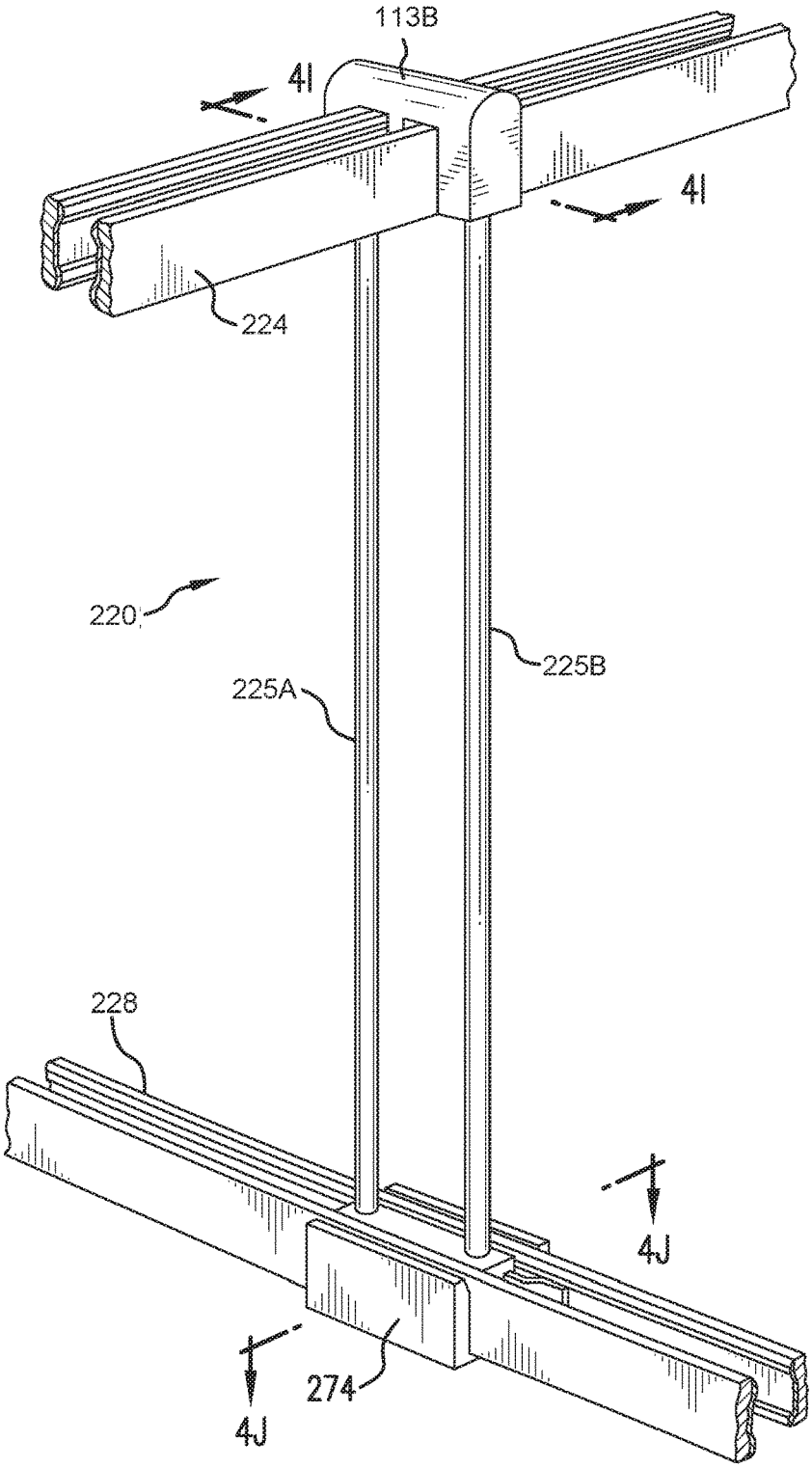
Figure 4I:
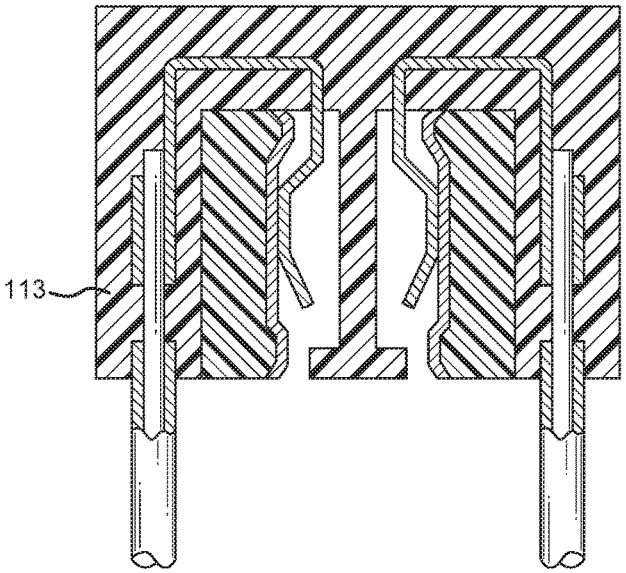
Figure 4J:
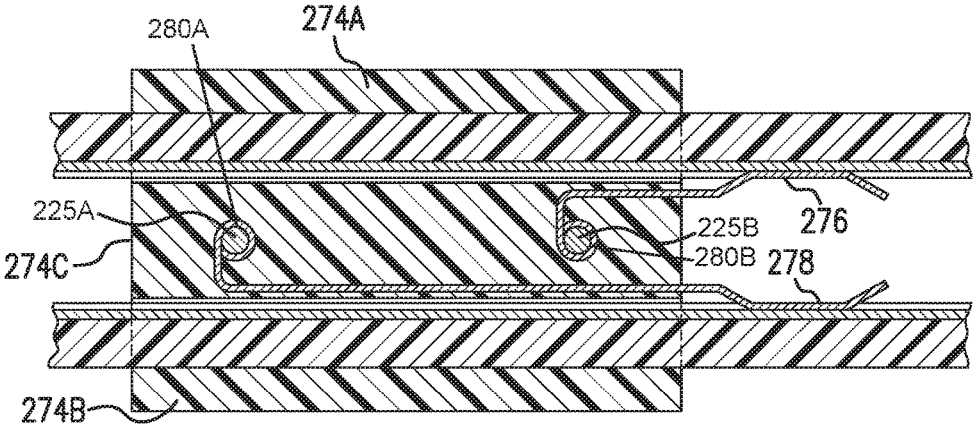

As discussed above, and illustrated in more detail below, in some instances, the power bars extend perpendicularly to each other. For example, in FIG. 2, the first power bar 224 and the second power bar 226 are perpendicular to each other. These power bars 224, 226 are interconnected using a hanger 220 that is shown in FIG. 4H. This hanger 220 has two segments 225A, 225B and a base 113B similar to the base 113 in FIGS. 4A-4G. However, at the bottom, the hanger 224 has a different base 274. This base 274 is formed with two side wings 274A, 274B and a center wall 274C. Clips 276, 278 are provided on the center wall 274C and are connected electrically with the segments 225A, 225B, respectively, as show in FIG. 4J. The center wall 274C is made with two holes 280A, 280B with the lower ends of the segments 225A, 225B extending into the holes 280A, 280B and secured to the base 274. The base 274 is sized and shaped to engage and support a power bar, for example, power bar 228, with the hanger segments 225A, 225B providing power to the power bar 228. The base 113B engages the segments of the power bar 224 in the manner discussed above.

Figure 5A:
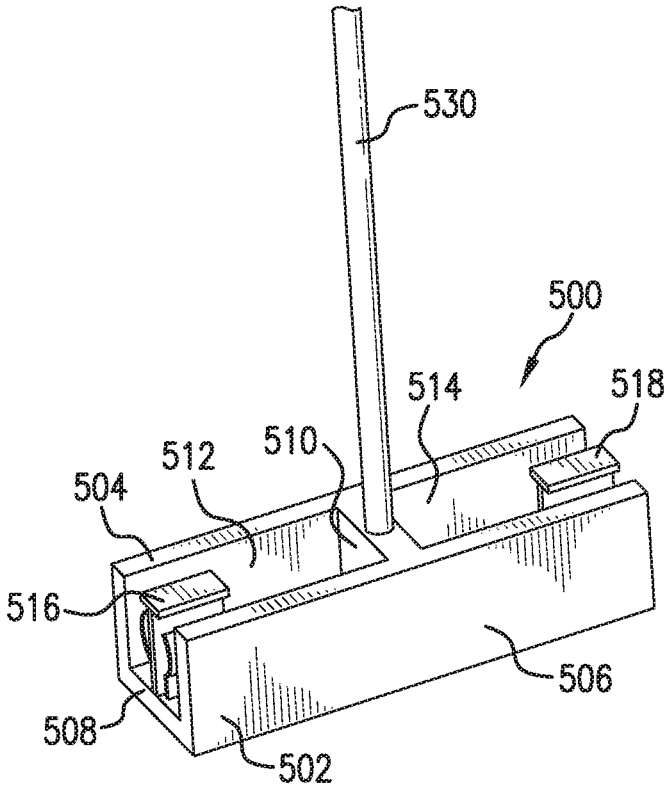
FIGS. 5A-5E are various views showing features of an embodiment of a hanger of the present invention configured to support and connect power bars.
Figure 5B:
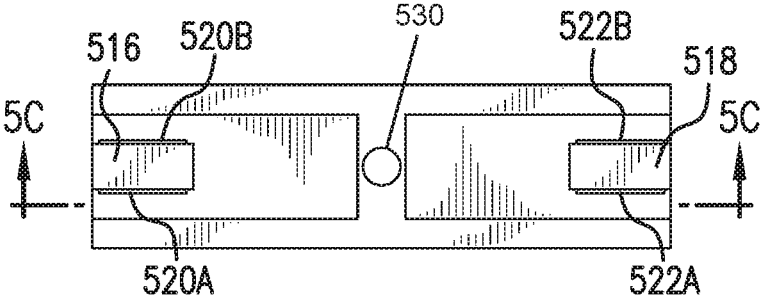
Figure 5C:
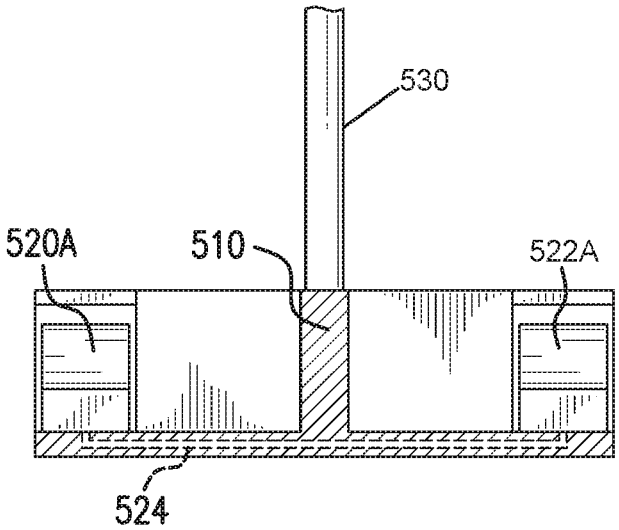
Figure 5D:
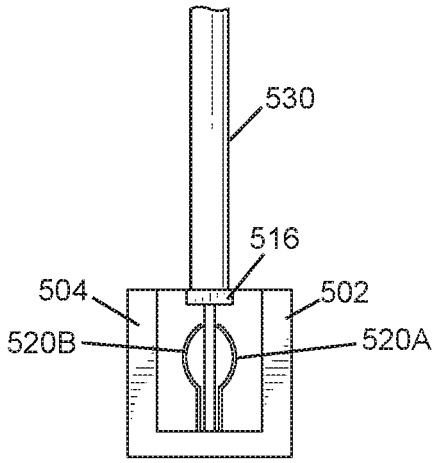

In the embodiments discussed above, the various power bars within a system configuration can be disposed at separate heights and may be supported by different hangers. FIGS. 5A-5E and 6A-6C illustrate hangers 500 and 600, respectively, that support and at least mechanically interconnect the respective ends of two power bars disposed at the same height. As shown in FIGS. 5A-5E, the hanger 500 includes a body 502 that has two outer walls 504, 506, that are spaced from each other, a bottom wall 508 and an interior wall 510 that extends between the outer walls 504, 506 to divide the space between the outer walls 504, 506 into two cavities 512, 514. Two additional interior walls 516, 518 are attached to bottom wall 508 and extend vertically into the cavities 512, 514, respectively. Electrical clips 520A, 520B are provided on opposite sides of the wall 516, and clips 522A, 522B are provided on opposite sides of the wall 518. These clips 520A, 520B, 522A, 522B have the same size and shape as the clips of the previously described hangers, such as the clips 119, 121 in FIG. 4B. The clips 520A, 520B, 522A, 522B may be electrically isolated from each other. Alternatively, as shown in FIG. 5C, the clips 520A, 522A may be electrically connected by a conductive element 524, preferably imbedded in body 502. A similar conductive element (not shown) can be used to connect clips 520B and 522B.

A rod 530 is attached to the wall 510 and extends upwards as shown. The rod 530 can extend to another power bar, to a canopy or some other structure to support the body 502. The rod 530 is not electrically connected to any other element of the lighting system.

Figure 5E:
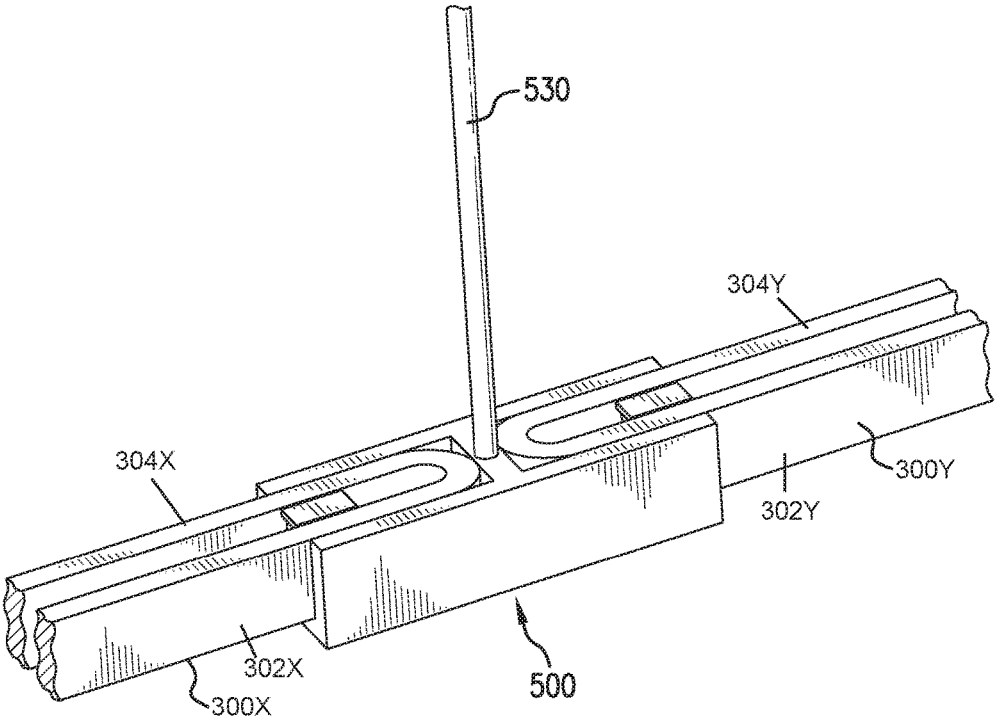

As shown in FIG. 5E, the hanger 500 can simultaneously support the respective ends of two power bars 300X, 300Y such that the ends of the power bars 300X, 300Y are in line with each other. The power bars 300X, 300Y have the structures similar to the power bar 300 shown in FIGS.

3A-3K. The bars 300X, 300Y are snapped into the cavities 512, 514 with the clips 520A, 520B, 522A, 522B mechanically engaging rails 302X, 304X, 302Y, 304Y of the power bars 300X, 300Y. If the clips 520A, 520B, 522A, 522B are isolated, the hanger 500 provides only mechanical support for the ends of the power bars 300X, 300Y. If the clips 520A, 520B, 522A, 522B are interconnected electrically, then they also provide electrical connection between the power bars 300X, 300Y.

Figure 6A:
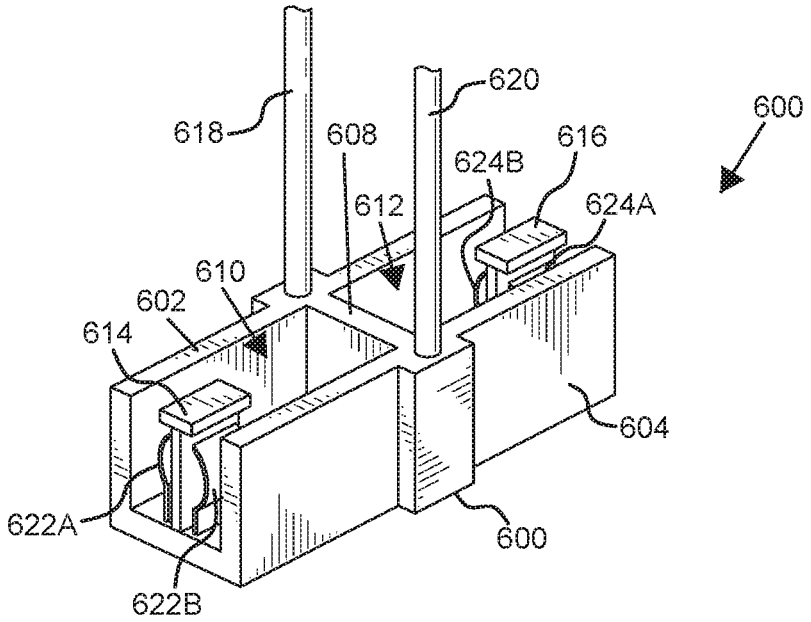
FIGS. 6A-6C are various views showing features of another embodiment of a hanger of the present invention configured to support and connect power bars.
Figure 6B:
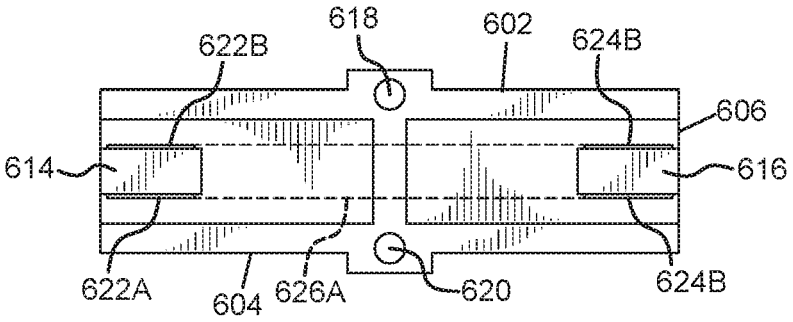
Figure 6C:
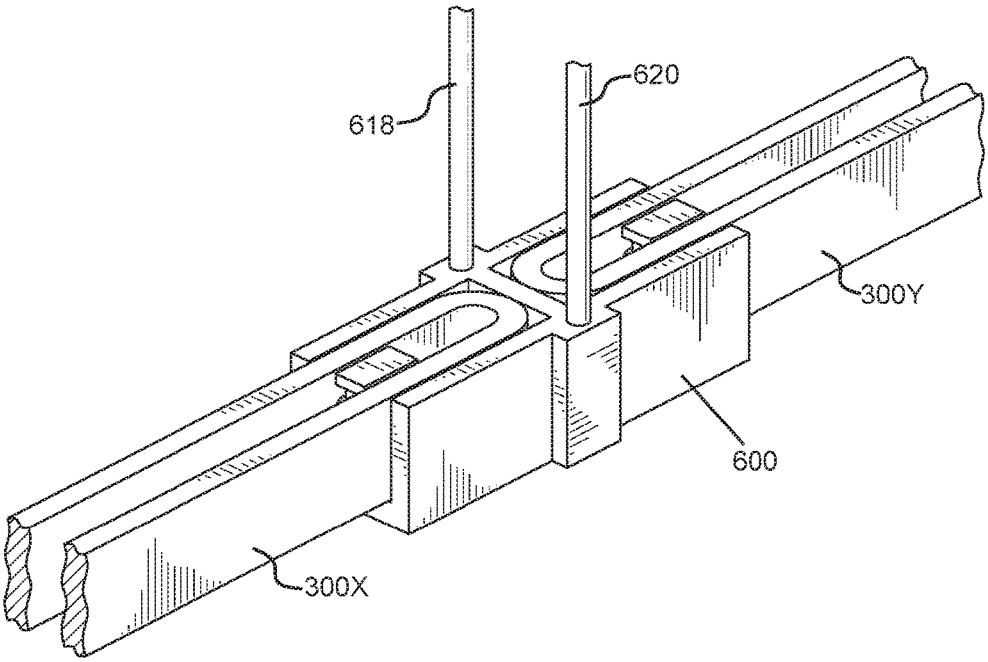

In FIGS. 6A-6C the hanger 600 is shown as having a structure similar to the hanger 500. The hanger 600 includes a hanger body 602 that has a first sidewall 602, a second sidewall 604 that is spaced from the first sidewall 602, a bottom wall 606 that extends between the sidewalls 602, 604, a first interior wall 508 that extends between the sidewalls 602, 604 and at least in part forms a first cavity 610 and a second cavity 612, a second interior wall 614 that extends upwardly from the bottom wall 606 into the first cavity 610 and a third interior wall 616 that extends upwardly from the bottom wall 606 into the second cavity 612. A first rod 618 and a second rod 620 that is spaced from the first rod 618 extend from the first interior wall 612 to support the hanger 600.

Electrical clips 622A, 622B are provided on opposite sides of the second interior wall 614, and electrical clips 624A, 624B are provided on opposite sides of the third interior wall 616. The clips 622A, 624A are electrically connected by a first conductor element 626A and the clips 622B, 624B are electrically connected to a second conductor element 628B. Importantly, as shown diagrammatically in FIG. 6B, the conductor elements 622A, 622B are also connected to the rods 618, 620, respectively. As a result, when the ends of bars 300X, 300Y are snapped into the cavities 610, 612, an electrical connection is established not only between the power bars 300X, 300Y, but also between the power bars 300X, 300Y and the rods 618, 620. The rods 618, 620 can be connected to a canopy, such as the canopy 102 in FIG. 1 or to another power bar using, for example, one of the hangers of FIG. 4F. As a result power is provided to both power bars 300X, 300Y from the rods 618, 620. Alternatively, power can be provided from one of the power bars, e.g., power bar to power bar 300Y and the rods 618, 620.

Numerous modifications may be made to this invention without departing from its scope as defined in the appended claims.

What is claimed is:

1. A hanger for supporting a first end of a first power bar and a first end of a second power bar of a modular lighting system, each of the first power bar and the second power bar include a first rail and a second rail that is spaced from the first rail that are configured to deliver power to pendants of the modular lighting system, said hanger comprising:

a body including base, a first sidewall extending from a first side of the base, a second sidewall that is spaced from the first sidewall extending from a second side of the base and an interior wall delimited between a first end and a second end and extending traverse between the first sidewall and the second sidewall with the first end of the interior wall extending contiguous to and directly contacting the first sidewall and the second end of the interior wall extending contiguous to and directly contacting the second sidewall, forming a first cavity that is configured to receive one of the first end of one of the first power and the second power bar and a second cavity that is configured to receive one of the first end of the other of the first end of the first power and the second power bar;

a first set of clips disposed in the first cavity that are adaptable to form an interference fit with the first rail and the second rail of one of the first bar and the second power bar;

a second set of clips, which are independent of and spaced from the first set of clips, disposed in the second cavity that are adaptable to form an interference fit with the first rail and the second rail of one of the first power bar and the second power bar; and a rod attached to and extending upwardly from said body.

2. The hanger of claim 1, further comprising at least one connector element electrically connecting one of the clips of the first set of clips to one of the clips of the second set of clips.

3. The hanger of claim 1, wherein the rod extends from the third sidewall.

4. The hanger of claim 1, further comprising a first inner wall disposed in said first cavity and a second inner wall disposed in said second cavity, said first set of clips being attached to said first inner wall and said second set of clips being attached to said second inner wall.

5. The hanger of claim 1, wherein said first set of clips and said second set of clips are electrically insulated.

6. A hanger for supporting a first end of a first power bar and a first end of a second power bar of a modular lighting system, the first power bar and the second power bar being disposed in line with each other and each of the first power bar and the second power bar including a first longitudinally extending rail and a second longitudinally extending rail that is spaced from the first rail, the first rail and the second rail being configured to support and provide power to pendants of the modular lighting system, the hanger comprising:

a body including base, a first sidewall extending from a first side of the base, a second sidewall that is spaced from the first sidewall extending from a second side of the base and an interior wall delimited between a first end and a second end and extending traverse between the first sidewall and the second sidewall with the first end of the interior wall extending contiguous to and directly contacting the first sidewall and the second end of the interior wall extending contiguous to and directly contacting the second sidewall and forming a first cavity that is configured to receive one of a first end of the first power bar and a first end of the second power bar and a second cavity that is independent of the first cavity and is configured-to receive the other of the first end of the first power bar and the first end of the second power bar;

a first interior wall extending from the base and disposed in said first cavity, the first protrusion having a first surface and a second surface that is opposed the first surface and a second protrusion extending from the base and disposed in said second cavity, the second interior wall having a first surface and a second surface that is opposed the first surface;

a first set of clips, including a first clip and a second clip, disposed on the first surface and the second surface, respectively, of the first protrusion;

a second set of clips, including a first clip and a second clip, disposed on the first surface and the second surface, respectively, of the second protrusion; and a rod attached to and extending upward from the body.

7. The hanger of claim 6, wherein the first set of clips and the second set of clips are electrically insulated from each other.

8. The hanger of claim 6, further comprising a first connecting element connecting one of the first clip and the second clip of said first set of clips to one of the first clip and the second clip of one of the first clip and the second clip of the second set of clips.

9. The hanger of claim 8, further comprising a second connecting element connecting the other one of the first clip and the second clip of said first set of clips to the other one of the first clip and the second clip of said second set of clips.

10. The hanger of claim 6, wherein said rod is electrically connected to one of the first set of clips and the second set of clips.

11. The hanger of claim 8, wherein said rod is electrically connected to said first connecting element.

12. The hanger of claim 9, further comprising a second rod that is electrically connected to said second connecting element.

* * * * *